US006191671B1

(12) United States Patent
Schlaak et al.

(10) Patent No.: US 6,191,671 B1
(45) Date of Patent: Feb. 20, 2001

(54) APPARATUS AND METHOD FOR A MICROMECHANICAL ELECTROSTATIC RELAY

(75) Inventors: Helmut Schlaak, Ober-Ramstadt; Lothar Kiesewetter, Berlin, both of (DE)

(73) Assignee: Siemens Electromechanical Components GmbH & Co. KG, Berlin (DE)

( * ) Notice: Under 35 U.S.C. 154(b), the term of this patent shall be extended for 0 days.

(21) Appl. No.: 09/486,261

(22) PCT Filed: Jul. 24, 1998

(86) PCT No.: PCT/DE98/02092

§ 371 Date: Feb. 22, 2000

§ 102(e) Date: Feb. 22, 2000

(87) PCT Pub. No.: WO99/10907

PCT Pub. Date: Mar. 4, 1999

(30) Foreign Application Priority Data

Aug. 22, 1997 (DE) ..... 197 36 674

(51) Int. Cl.[7] ..... H01H 51/22
(52) U.S. Cl. ..... 335/78; 200/181; 257/421
(58) Field of Search ..... 335/78–86; 200/181; 257/414, 418, 420, 421, 531; 438/48, 50; 29/599, 622

(56) References Cited

U.S. PATENT DOCUMENTS 4,570,139 2/1986 Kroll .
4,959,515 * 9/1990 Zavracky et al. ..... 200/181
5,258,591 * 11/1993 Buck ..... 200/181
5,260,596 * 11/1993 Dunn et al. ..... 257/414
5,278,368 * 1/1994 Kasano et al. ..... 200/181
5,430,421 7/1995 Bornand et al. .
5,578,976 * 11/1996 Yao ..... 333/262
5,629,565 * 5/1997 Schlaak et al. ..... 257/780
5,828,115 * 10/1998 Core ..... 257/420
6,057,520 * 5/2000 Goodwin-Johansson ..... 200/181

FOREIGN PATENT DOCUMENTS 42 05 029 C1 2/1993 (DE) .
44 37 259 C1 10/1995 (DE) .
44 37 260 C1 10/1995 (DE) .
44 37 261 C1 10/1995 (DE) .

* cited by examiner

*Primary Examiner*—Lincoln Donovan
*Assistant Examiner*—Tuyen T. Nguyen
(74) *Attorney, Agent, or Firm*—Schiff Hardin & Waite

(57) ABSTRACT

An apparatus and method for a micromechanical electrostatic relay that includes a base substrate and a carrier layer deposited onto the base substrate. The carrier layer includes an armature and stationary-contact spring tongues that engage each other at their respective free ends. Once engaged, the armature spring tongue moving contacts overlaps the respective stationary-contact spring tongue stationary contacts. During an electrostatic rest state, the armature and stationary-contact spring tongues curve away from the base substrate wherein their respective free ends no longer engage.

17 Claims, 4 Drawing Sheets

APPARATUS AND METHOD FOR A MICROMECHANICAL ELECTROSTATIC RELAY

BACKGROUND OF THE INVENTION

1. Field of the Invention

The invention relates to a micromechanical electrostatic relay having a base substrate with a base electrode and with at least one stationary contact, an armature spring tongue which is linked on one side to a carrier layer connected to the base substrate, has an armature electrode opposite the base electrode, is elastically curved away from the base substrate in the rest state forming a wedge-shaped air gap, and is fitted at its free end with at least one moving contact opposite the stationary contact. In addition, the invention relates to a method for producing such a relay.

2. Description of the Prior Art

Such a micromechanical relay and an appropriate production method have already been disclosed, in principle, in German Patent Document No. 42 05 029 C1. The essential feature in this case is that the armature spring tongue, which is exposed from a substrate, is curved in such a manner that the armature electrode forms a wedge-shaped air gap with the opposite base electrode, which air gap, when a voltage is applied between the two electrodes, produces a rapid attraction movement on the basis of the so-called moving-wedge principle. Refinements of this principle have been disclosed, for example, in German Patent Document No. 44 37 259 C1 and German Patent Document No. 44 37 261 C1.

In the case of all these known relays with a micromechanical construction, a relatively high manufacturing effort is involved since two substrates, namely on the one hand a base substrate with the base electrode and the stationary contact, and on the other hand an armature substrate with the armature spring tongue, the armature electrode and the moving contact, have to be produced separately and connected to one another. In addition to the said main functional elements of the two substrates, further coating and etching processes are involved, for example for insulating layers, leads and the like. Each of the two substrates therefore has to be subjected on its own to all of the complex processes involved before their main functional layers can be connected, facing one another. Since the switching elements are also intended to be protected against environmental influences, an additional covering part is, as a rule, required as a closing element, although there is no need to describe this in any more detail.

In order to simplify production, it would be desirable if it were possible to form all the functional elements of the relay on a substrate from one side. In this case, it is in principle feasible to form a stationary contact element and a spring tongue with a moving contact on one and the same substrate, in which case, for example, the stationary contact and the moving contact can be produced one above the other, and the contact gap can be formed by etching away a so-called sacrificial layer. Such an arrangement has been disclosed in principle in U.S. Pat. No. 4,570,139. However, in the case of the micromechanical switch there, a cavity that is not accurately defined is created underneath the armature spring tongue, and this cavity is not suitable for the formation of an electrostatic drive. In the case of the switch there, provision is therefore made for both the armature spring tongue as well as the stationary contact to be provided with a magnetic layer in each case, and for the switch to be operated via an externally applied magnetic field. Even in the case of the relatively short contact gap which can be achieved between the moving contact and the rigid stationary contact using the sacrificial layer technique, such a magnetic field can be used to produce the required contact force. However, to do this, an additional device is required to produce the magnetic field, for example a coil, and this occupies considerably more space than is available for a micromechanical relay in certain aplications.

SUMMARY OF THE INVENTION

The aim of the present invention is to develop the design of a micromechanical relay of the type mentioned initially such that greater contact forces can be produced even with the electrostatic drive, but in which the functional elements of the relay can be produced on the base substrate by action from one side.

According to the invention, this aim is achieved in that the at least one stationary contact is arranged on a stationary-contact spring tongue which, opposite the armature spring tongue, is linked like this on one side to a carrier layer and is elastically curved away from the base substrate in the rest state, and in that the at least one moving contact is formed at the free end of the armature spring tongue such that it projects beyond said armature spring tongue and overlaps the stationary contact.

Thus, in the case of the invention, in contrast to previous proposals for micromechanical relays and switches, the stationary contact is also no longer rigidly arranged on the base substrate but is seated, like the moving contact, on a curved spring tongue, which allows an additional switching movement to be achieved. The moving contact is seated on the armature spring tongue and overlaps the stationary contact. The prior curvature of the two mutually opposite spring tongues thus allows an adequate over-travel to produce the desired contact force to be achieved from the start of contact-making to the final position of the armature during switching. This effect is achieved even if only a relatively small free space can be created underneath the armature when the armature spring tongue is formed on a base substrate using the sacrificial layer technique, by virtue of which relatively small free space the armature is given only a small, specific over-travel beyond its extended position when attraction to the opposing electrode occurs.

Production is particularly advantageous if both the armature spring tongue and the stationary-contact spring tongue are formed from the same carrier layer, and can thus be produced in one and the same etching process. The spring tongues, whose free ends are opposite one another, can engage in one another in an advantageous manner like teeth, so that the projecting moving contact can be connected, not only at its rear end but at least on one side as well, to the surface of the armature spring tongue. The specific design is dependent on whether the intention is to create a make contact or a bridge contact.

Silicon is the preferred material for the base substrate, in which case the carrier layer for the spring tongues is deposited or bonded on as a silicon layer with the interposition of the respectively required functional and insulating layers, and is etched free in the appropriate processes. Alternatively, the base substrate may be composed of glass or ceramic; these materials are considerably more cost-effective than silicon. However, ceramic requires an additional surface treatment in order to obtain the smooth surface required for the relay structures. The carrier layer which forms the spring tongues may, for example, be composed of deposited polysilicon or polysilicon with recrystallisation, or may be an exposed, doped silicon layer of a bonded-on silicon wafer. This layer can be produced by epitaxy or diffusion in a silicon wafer. Alternatively, a deposited layer of a spring metal, such as nickel, a nickel-iron alloy or nickel with other additives can be used in addition to this silicon structure. Other metals may also be used; the important factor is that the material has good spring characteristics and suffers little fatigue.

An advantageous method for producing a relay according to the invention has the following steps:

a metal carrier layer is applied, with the interposition of an insulating layer and an intermediate space, to a base substrate which is provided with a metal layer as the base electrode, two spring tongues which are linked on one side and whose free ends are opposite one another are formed in the carrier layer, at least in places, the spring tongues are provided with a tensile stress layer on their top surface, a—preferably shorter—spring tongue is provided at its free end with at least one stationary contact, the—preferably longer—spring tongue is provided with at least one moving contact which overlaps the stationary contact, with the interposition of a sacrificial layer, and the curvature of the spring tongues upwards away from the substrate is achieved by etching the spring tongues free from one another and from the substrate.

Further refinements of the production method are quoted in claims 14 to 16.

DESCRIPTION OF THE PREFERRED EMBODIMENT

First of all, it should be mentioned that all the layer illustrations show the layer sequence only schematically and not the thickness ratios of the layers.

Figure 1:
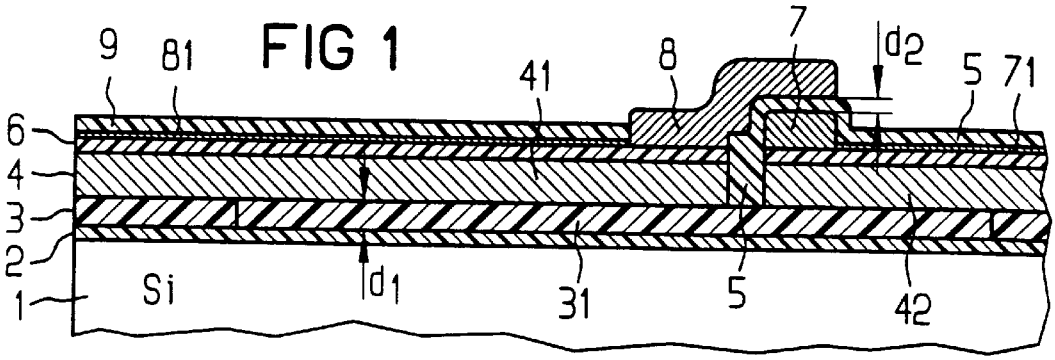
FIG. 1 shows a section illustration of the layout of the essential functional layers of a micromechanical relay.
Figure 2:
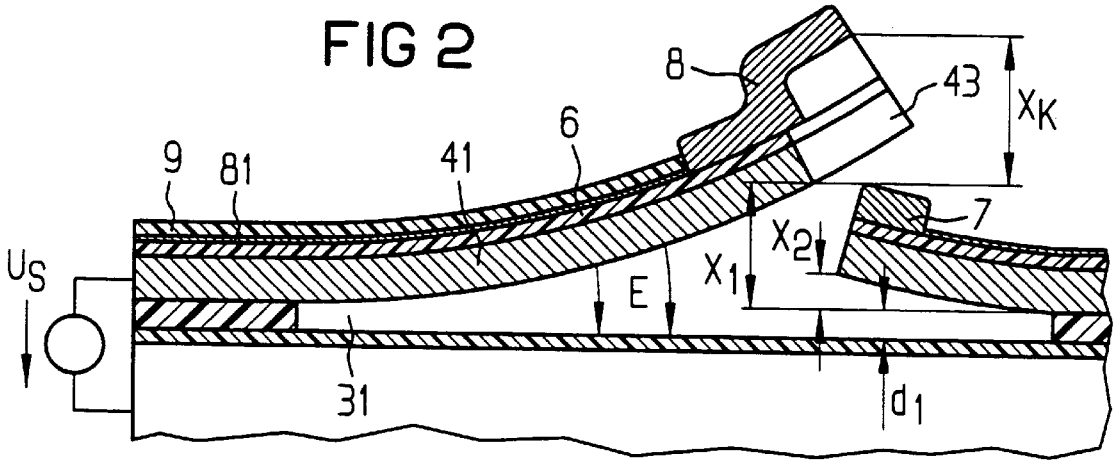
FIG. 2 shows the micromechanical relay from FIG. 1 in the final state (without a casing) in the rest position.
Figure 3:
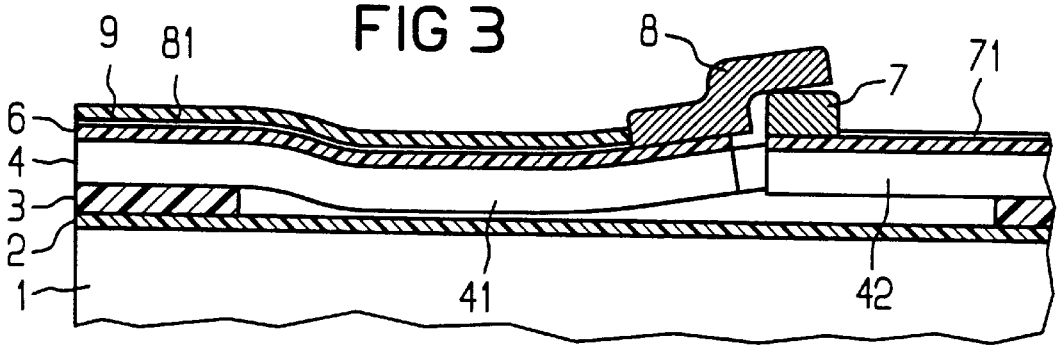
FIG. 3 shows the relay from FIG. 2 in the operating position.

FIGS. 1 to 3 show the functional layer structure of a micromechanical relay according to the invention based on silicon. In this case, the base substrate 1 is composed of silicon. This base substrate is at the same time used as the base electrode; alternatively, a corresponding electrode layer can be formed by suitable doping, if required. An insulating layer 2, composed of silicon nitrite for example, is formed above the base substrate. A first sacrificial layer 3, which is etched out later, is in turn located on this insulating layer 2. This first sacrificial layer 3 is composed, for example, of silicon dioxide and has a thickness $d_1$ of, preferably, less than 0.5 $\mu$m. A carrier layer 4 is located above the sacrificial layer 3, in order to form the spring tongues. This carrier layer is electrically conductive and is composed, for example, of polysilicon with a thickness of 5 to 10 $\mu$m. An armature spring tongue 41 and a stationary-contact spring tongue 42 will be etched out of this carrier layer 4 later.

In the layer structure, they are initially separated from one another by a second sacrificial layer 5. An insulating tensile-stress layer 6 is arranged on the two spring tongues 41 and 42 and, once the spring tongues have been etched free, produces the upward curvature of the spring tongues away from the base substrate, by virtue of its tensile stress. This state is shown in FIG. 2.

Figure 4:
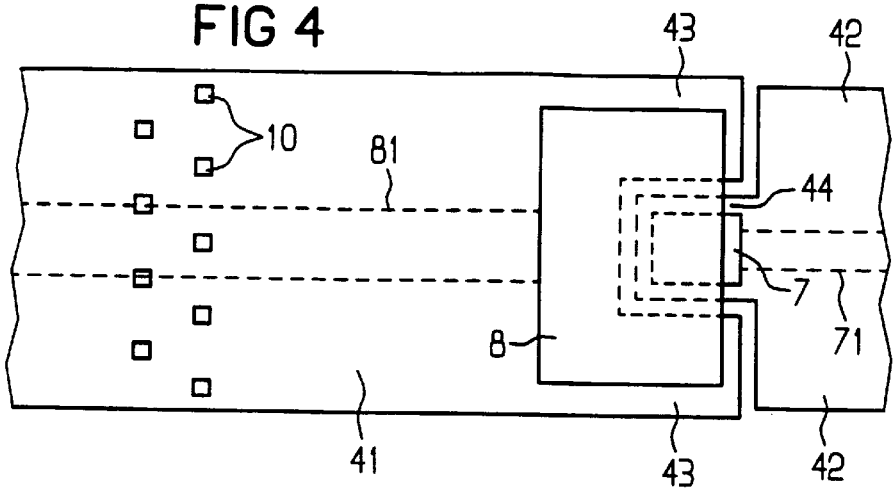
FIG. 4 shows a plan view of the relay from FIG. 3, which forms a make contact.

A stationary contact 7 is deposited on the stationary-contact spring tongue 42 by means of an appropriate coating method, while a moving contact 8 is formed on the free end of the armature spring tongue 41 in such a way that it overlaps the stationary contact 7, with the interposition of the second sacrificial layer 5. The height of the switching contacts can be varied as required, and is typically between 2 and 10 $\mu$m. Depending on the requirement, the thicknesses and the material compositions of the switching contacts may also be asymmetric. As is shown in FIG. 4, the two spring tongues 41 and 42 engage in one another like teeth, so that a central projection 44 on the spring tongue 42 is surrounded by two lateral projections 43 on the armature spring tongue 41, in the form of pliers. In this way, the moving contact 8 has three side sections which rest on the armature spring tongue. In this configuration, it forms a single make contact with the stationary contact 7. As can also be seen, the moving contact 8 has an S-shaped or Z-shaped cross-section, in order to ensure the overlap with the stationary contact 7. The interposed sacrificial layer 2 typically has a thickness $d_2$ of less than 0.5 $\mu$m.

The other required layers are formed in a known manner, for example a lead 71 to the stationary contact 7, a lead 81 to the moving contact 8, and a further insulating layer 8 for passivation of the top surface of the armature spring tongue.

FIG. 2 shows the complete arrangement after the spring tongues have been exposed by etching away the two sacrificial layers 3 and 5, in which case there is a free space 31 underneath the armature spring tongue 41. As mentioned, the two spring tongues 41 and 42 curve upwards because of the tensile-stress layer 6, so that the arrangement according to FIG. 2 is produced, with an open contact. The armature spring tongue curves because of the prestressing to form an unobstructed opening $x_1$ at the spring end. In the same manner, the stationary-contact spring tongue 42 curves upwards, after exposure, through the unobstructed opening $x_2$. The unobstructed contact gap thus becomes $x_K=x_1-x_2+d_2$ and approximately $x_K=x_1-x_2$.

This unobstructed contact gap $X_K$ can be set as required by the geometry of the armature spring tongue and the stationary-contact spring tongue as well as the tensile stress caused in the spring by the layer 6.

FIG. 3 shows the relay in the closed switching state. In this case, the armature spring tongue 41 is resting directly on the opposing electrode, that is to say it is touching the insulation layer 2 of the opposing electrode or of the base substrate. The armature spring tongue is thus bent downwards by the thickness of the first sacrificial layer 3, namely $d_1$. This results in an overtravel of $x_u=x_2-d_2+d_1$, that is to say, approximately $x_u=x_2$.

This overtravel is independent of the manufacturing tolerances of the contact heights.

As mentioned, FIG. 4 shows a plan view of the spring tongues 41 and 42 according to FIGS. 1 to 3. The shape and the arrangement of the contacts can be seen in this case, namely of the stationary contact 7 on the projection 44 on the spring tongue 42, as well as of the moving contact 8, which is attached on three sides to the projections 43 on the spring tongue 41. In addition, a hole grid 10 for etching through the first sacrificial layer 3 is shown by way of indication.

Figure 5:
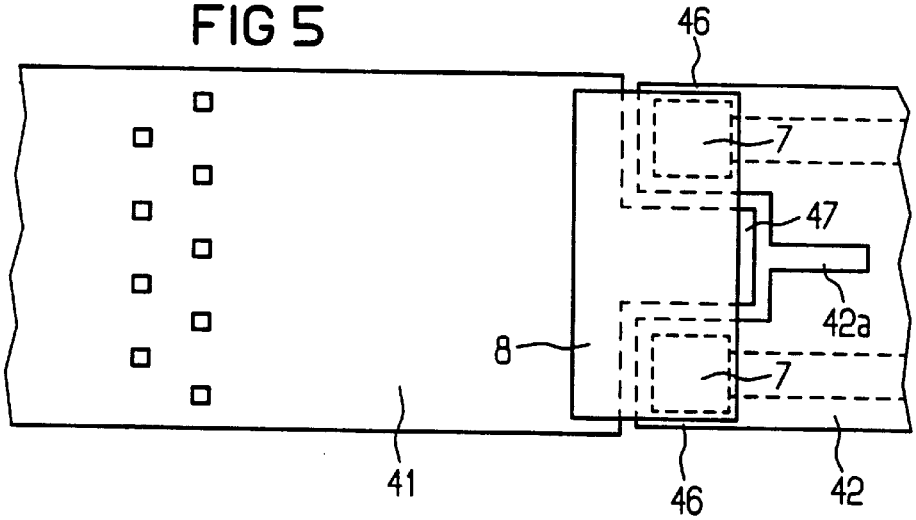
FIG. 5 shows the same view as FIG. 4, but with an embodiment which forms a bridge contact.

FIG. 5 shows an embodiment, modified from that in FIG. 4, with a bridge contact. In this case, the spring tongue 42 has two separate stationary contacts 7 with corresponding interconnects on two outer projections 46, while the spring tongue 41 forms a central projection 47, on which the moving contact 8 rests. A slot 42*a* in the stationary-contact spring tongue 42 ensures a high level of torsional flexibility in order that both contacts close reliably in the event of an equal erosion. In the case of this example, this is used as a bridge contact, in that it overlaps the stationary contacts 7 on both sides.

Figure 6:
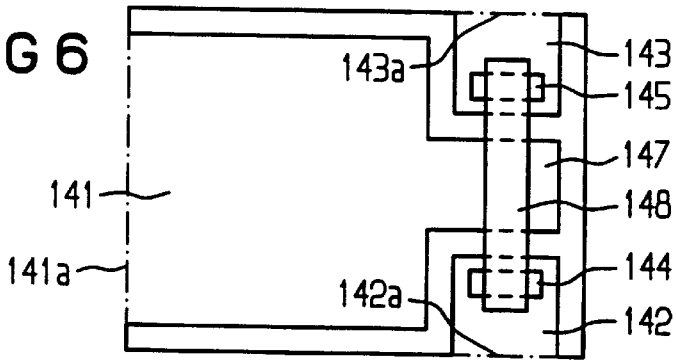
FIG. 6 shows a modified embodiment of a bridge-contact arrangement.

The same effect can also be achieved with a structure according to FIG. 6. There, an armature spring tongue 141 is provided with a central projection 147 on which a moving bridge contact 148 rests, which projects on both sides. This bridge contact 148 interacts with two stationary contacts 144 and 145, which are seated on two separate stationary-contact spring tongues 142 and 143. These stationary-contact spring tongues 142 and 143 are positioned transversely with respect to the armature spring tongue 141, that is to say their clamping-in lines 142*a* and 143*a* are at right angles to the clamping-in line 141*a* of the armature spring tongue.

Figure 7:
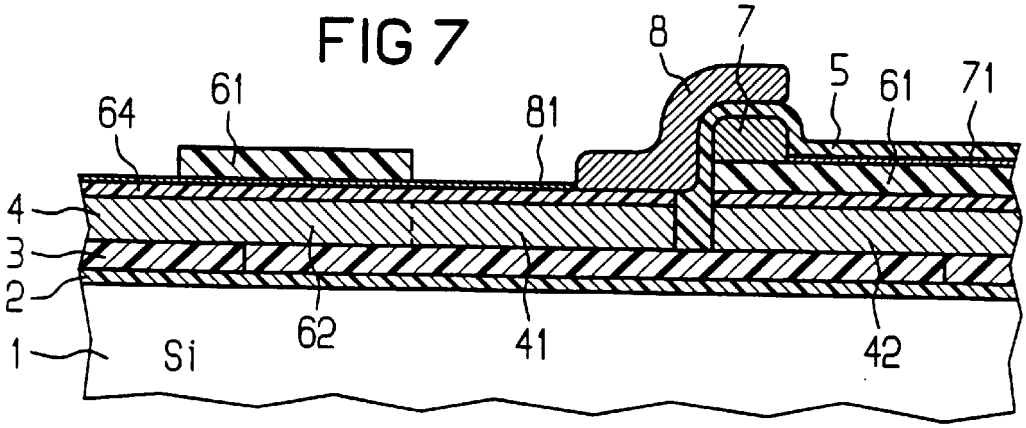
FIG. 7 shows an illustration corresponding to FIG. 1, but with a tensile-stress layer above a partial section of the armature spring tongue.
Figure 8:
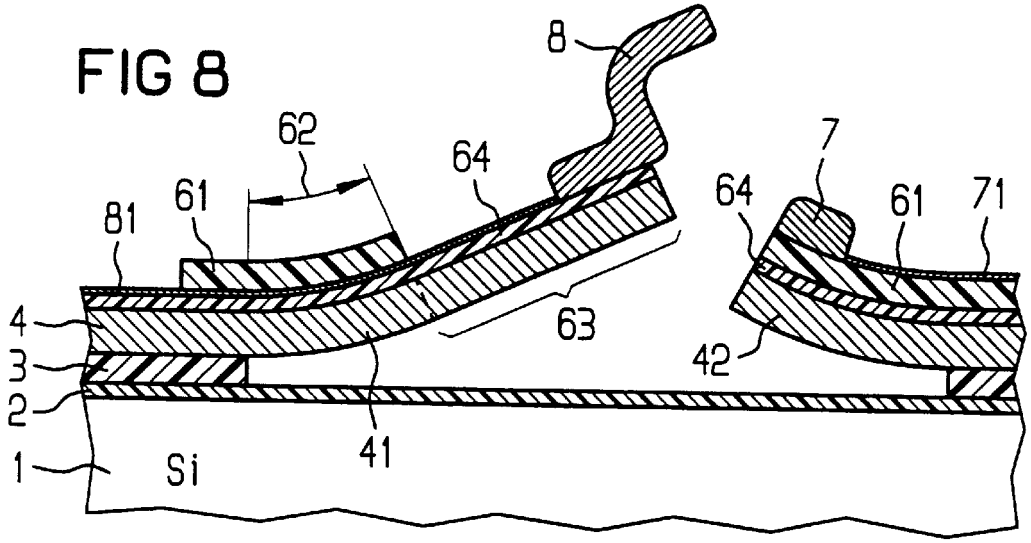
FIG. 8 shows a view corresponding to FIG. 2 with spring-tongue sections of different curvature.

In order to optimize the switching characteristic, it is expedient to curve the armature spring tongue only in places, as is described in detail in the documents German Patent Document No. 44 37 260 C1 and German Patent Document No. 44 37 261 C1. FIGS. 7 and 8 show schematically a configuration during production and in the completed state, in which the armature spring tongue is designed to be only partially curved. In comparison to FIGS. 1 and 2, the major difference is that, in FIGS. 7 and 8, a tensile-stress layer 61 extends only over a part of the armature spring tongue 41, so that a curved zone 62 of the armature spring tongue is limited to the region of the clamping-in point, while a zone 63 runs in a straight line, or with relatively little curvature, towards the spring end. In the illustration in FIGS. 7 and 8, an insulation layer 64 without any built-in stress is illustrated on the silicon carrier layer 4, and this insulation layer 64 forms the DC isolation of the load circuit with the lead 81 from the spring tongue. The already mentioned tensile-stress layer 61 is located above this.

Figure 9:
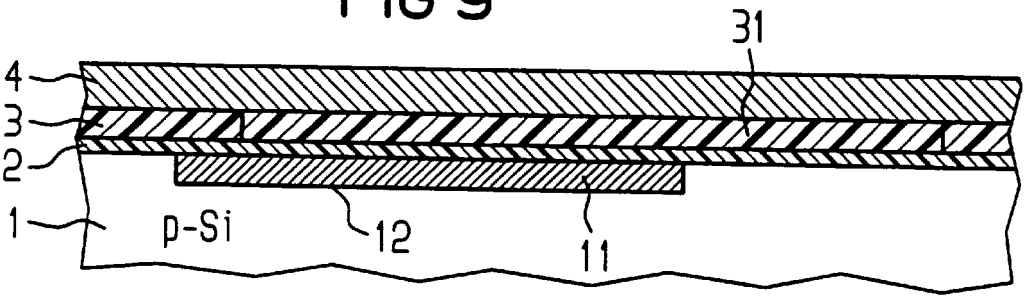
FIG. 9 shows a layer structure which is somewhat modified from that in FIG. 1, of a base substrate up to the formation of a carrier layer composed of polysilicon for the spring tongues.

Various methods which are known per se can be used to produce the layer arrangement described and illustrated. For example, FIG. 9 shows the basic layer structure on the base substrate 1 as created using the so-called additive technique. In the case of this method, the moving spring tongues and their carrier layer are produced from a material which is deposited on the substrate only during production. In the illustrated example in FIG. 9 a wafer composed of p-silicon is used as the substrate. A control base electrode 11 is first of all produced on this substrate n- by diffusion (for example with phosphorus); a depletion layer 12 is formed between the n-silicon of the electrode and the p-silicon of the base substrate. The insulation layer 2 and, above this, the sacrificial layer 3 are applied and structured over the electrode. The carrier layer 4 is deposited above this, with a thickness of, for example, 5 to 10 $\mu$m. This carrier layer 4 is composed of polysilicon or of polysilicon with recrystallization. The structure of the spring tongues is produced using a conventional mask technique. The rest of the structure is produced as in FIG. 1. The various functional layers, namely an insulation layer between the load circuit and the moving drive electrode, possibly an additional tensile-stress layer and the necessary load circuit interconnects are thus deposited. In addition, the described contacts are produced with the interposed second sacrificial layer as well as any passivation insulation required for the interconnects.

Figure 10:
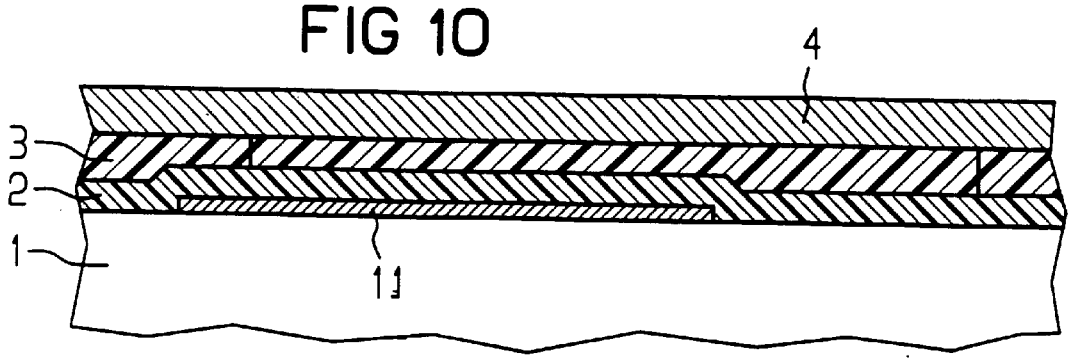
FIG. 10 shows a layer structure, modified from that in FIG. 9, with a carrier layer composed of metal for the spring tongues.

As already mentioned in the introduction, other materials may also be used. For example, FIG. 10 shows schematically a layer arrangement in which the substrate is composed of glass. Alternatively, it could be composed of a silicon substrate with an insulation layer, or of ceramic with appropriate surface treatment. A base electrode 11 in the form of a metal layer is produced above this substrate. An insulating layer 2 is then located on this metal layer and, above this, the sacrificial layer 3. In this example, an electrochemically applied metal layer is used as the carrier layer, this metal layer being composed of nickel or a nickel alloy (for example nickel-iron), or else of another metal alloy. The important factor is that this metal has a spring characteristic with little fatigue. Inhomogeneous nickel layers can be produced by appropriate current passage during the electrochemical process and these produce subsequent curvature of the structured spring tongues. The rest of the construction takes place analogously to FIG. 9 and FIG. 1.

Figure 11:
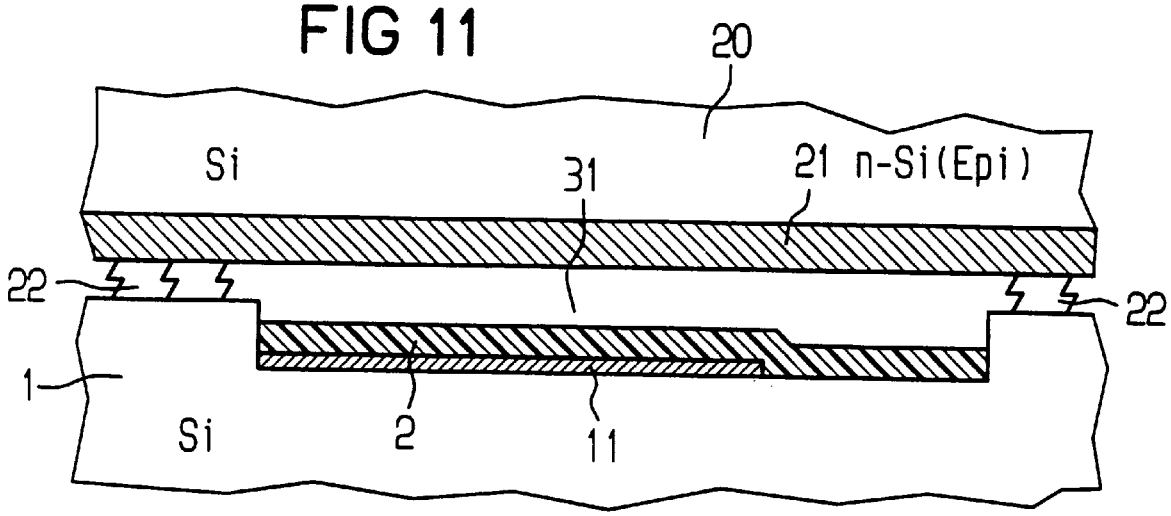
FIG. 11 shows a layer structure, modified from that in FIGS. 9 and 10, with a lost-wafer layer bonded on to the base substrate in order to form the carrier layer for the spring tongues.

A further option for producing the functional layers of the relay is the so-called lost-wafer technique. This will be described briefly with reference to FIG. 11 In this case, two original substrates are used, although they experience layer processing from one surface. A base electrode 11 which, in this example, is recessed in an etched V-groove, is first of all applied to a base substrate 1 which, in turn, is composed of silicon or of glass. The insulation layer 2 is located above this base electrode 1. After this, a second silicon wafer 20 with an n-doped silicon layer 21, which is either applied by epitaxy or is produced by diffusion, is anodically bonded to the already structured base substrate 1. This is followed by the wafer 20 being etched back from the top surface using electrochemical etching resist so that only the epitaxial layer 21 remains, and this is used as the carrier layer for the moving spring tongues. The step of joining the lost wafer to the base substrate can also be carried out without the first sacrificial layer 3 (see FIG. 1), provided a free space 31 can, be formed without the insulation layer 2 firmly bonding to the doped silicon layer 21.

Finally, in the case of this example as well, the structuring of the load circuit elements is carried out analogously to the additive technique, as has already been described with reference to FIG. 1 and FIG. 6. Thus, for example, an insulation layer 64 for insulation between the load circuit and the drive electrode formed by the spring tongue 41, to the extent that this is required, an additional tensile-stress layer 61, the load circuit interconnects 71 and 81, the stationary contact 7, the second sacrificial layer 5 and the moving contact 8 are applied and structured successively. If any additional layers are required for passivation insulation, this is done in accordance with the knowledge within the experience of a person skilled in the art.

Figure 12:
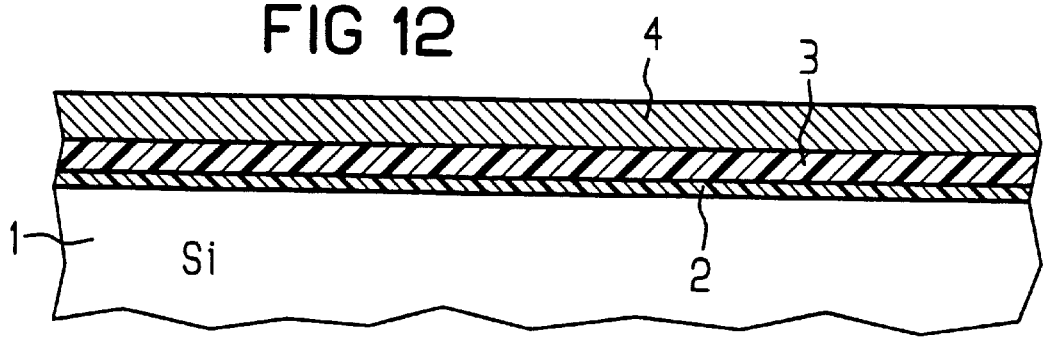
FIG. 12 shows a modified layer structure using an SOI wafer semi-finished product.

Another option for producing the structure according to the invention is to use a so-called SOI wafer (silicon-on-insulator). FIG. 12 shows such an SOI wafer as a semi-finished product. The difference from the construction according to FIG. 9 is that the individual layers are in this case not retrospectively deposited on the substrate but, instead of this, such an SOI wafer as a semi-finished product has a prefabricated layer structure, in which case an insulation layer 2, for example composed of silicon nitrite, a first sacrificial layer 3, for example composed of silicon dioxide, and a crystalline silicon epitaxial layer as a carrier layer 4 with a thickness of, for example, 5 to 10 $\mu$m are arranged on the silicon substrate 1. The structuring of the load circuit elements is then carried out on this semi-finished product analogously to the additive technique described above, in which case the insulation layer 64, the additional tensile-stress layer 61, the load circuit interconnects 71 and 81, the stationary contact 7, the second sacrificial layer 5 (possibly also as passivation insulation for the interconnects) and the moving contact 8 are structured as functional layers.

The function of the relay results directly from the described structure. A control voltage $U_s$ is applied to the electrodes via appropriate connecting elements in order to operate the relay, that is to say according to FIG. 2 to the substrate 1, which is at the same time used as the base electrode, or to the base electrode (which is electrically insulated from the base substrate) according to the embodiments in FIGS. 9 to 11, and to the armature spring tongue 41, which is at the same time used as the armature electrode. Electrostatic charging results in the armature spring tongue 41 being attracted to the base electrode, as a result of which the contacts close.

It is also clear to the person skilled in the art that the structure illustrated in the drawing is installed in a suitable manner in a casing, so that the contacts are protected against environmental influences. It should also be mentioned that a plurality of illustrated switching units can be arranged alongside one another on one and the same substrate and can be arranged in a common casing, in order to form a multiple relay.

Although modifications and changes may be suggested by those skilled in the art, it is the intention of the inventors to embody within the patent warranted hereon all changes and modifications as reasonably and properly come within the scope of their contribution to the art.

We claim as our invention:

1. A micromechanical electrostatic relay comprising:

a base substrate having a base electrode and a carrier layer attaching to said base substrate wherein said carrier layer includes a carrier layer first and second end;

a micromechanical armature spring tongue having an armature electrode and extending along said carrier layer first end wherein said armature electrode is oppositely located from said base electrode, and micromechanical armature spring tongue having an armature free end and forming an armature wedge-shaped gap by elastically curving away from said base substrate during an electrostatic relay rest state, said armature free end including a plurality of armature free end moving micromechanical contacts wherein each of said armature free end moving micromechanical contacts project beyond said armature free end; and a micromechanical stationary-contact spring tongue having a contact free end and extending along said carrier layer second end, said contact free end including a plurality of contact free end micromechanical stationary contacts overlapping each of said contact free end stationary micromechanical contacts and with each of said contact free end stationary micromechanical contacts curving away from said base substrate during said electrostatic relay rest state.

2. The micromechanical electrostatic relay according to claim 1 wherein said carrier layer is formed of said micromechanical armature spring tongue and said micromechanical stationary-contact spring tongue.

3. The micromechanical electrostatic relay according to claim 1 wherein each of said armature free end moving micromechanical contacts comprise a Z-shaped moving contact configuration, said Z-shaped moving contact configuration includes a first and second Z-shaped member wherein said first Z-shaped member rests on said micromechanical armature spring tongue and said second Z-shaped member overlaps each of said contact free end stationary micromechanical contacts while being positioned parallel relative to each of said contact free end stationary micromechanical contacts.

4. The micromechanical electrostatic relay according to claim 1 wherein said micromechanical armature free end comprises a plurality of armature free end recesses and projections and wherein said contact free end comprises a plurality of contact free end recesses and projections, said armature free end engages said contract spring free end so as to form a tooth shape configuration, said tooth shape configuration includes each of said armature free end recesses and projections engaging each of said respective contact free end recesses and projections, each of said contact free end stationary contacts rest on each of said contact free end projections so as each of said armature free end moving contacts overlaps each of said contact free end recesses.

5. The micromechanical electrostatic relay according to claim 1 wherein said armature free end comprises an armature free end plier member and said contact free end comprises a contact free end central projection that is fitted with each of said contact free end stationary contacts, said armature free end plier member encloses said contact free end central projection so as each of said armature free end moving micromechanical contacts rest on and extend over at least a portion of each of said contact free end stationary micromechanical contacts.

6. The micromechanical electrostatic relay according to claim 1 wherein said armature free end comprises a central armature projection having an armature moving bridge contact and said contract free end comprises two contact free end projections, said central armature projection engages said contact free end between said two contact free end projections, said two contact free end projections both include each of said contact free end stationary micromechanical contacts so as said armature moving bridge contact extends freely over at least a portion of each of said contact stationary contacts micromechanical when said central armature projection engages said contact free end.

7. The micromechanical electrostatic relay according to claim 6 wherein said armature central projection having two central projection sides is fitted with said armature moving bridge contact that projects beyond said two central projection sides and wherein said contact free end includes two contact free end projections that are each fitted with a stationary contact, each of said stationary contacts interacts with said armature moving bridge contact.

8. The micromechanical electrostatic relay according to claim 1 wherein a sacrificial layer and said carrier layer is deposited onto said base substrate, said sacrificial layer is disposed between said carrier layer and said base substrate.

9. The micromechanical electrostatic relay according to claim 1 wherein said base substrate and said carrier layer comprise silicon and wherein said base electrode and said annature electrode comprise a doped silicon.

10. The micromechanical electrostatic relay according to claim 1 wherein said micromechanical armature spring tongue and said micromechanical stationary-contact spring tongue each comprise a length and a side facing away from said base substrate and wherein a tensile stress layer is attached to each of said armature spring tongue and said stationary-contact spring tongue on said side facing away from said base substrate, said tensile stress layer extends along at least a portion of said length of each of said micromechanical armature spring tongue and said micromechanical stationary-contact spring tongues.

11. The micromechanical electrostatic relay according to claim 1 wherein said carrier layer is selected from the group consisting of deposited polysilicon and re-crystallized polysilicon.

12. The micromechanical electrostatic relay according to claim 1 wherein said carrier layer comprises an electromechanically deposited metal carrier layer selected from the group consisting of nickel, nickel-iron, and nickel alloy.

13. The micromechanical electrostatic relay according to claim 1 wherein said base substrate is selected from the group consisting of silicon and glass and wherein said carrier layer comprises a silicon carrier layer having a silicon wafer.

14. A method for producing a micromechanical electrostatic relay comprising the steps of:

applying an electricallyconductive carrier layer, an insulating layer, an intermediate layer, and a sacrificial layer to a base substrate having a base electrode wherein said insulating layer and said intermediate layer are disposed between said carrier layer and said base substrate;

forming a first micromechanical spring tongue and second micromechanical spring tongue of said electrically conductive carrier layer, each of said first and second micromechanical spring tongues including a free end, a length and a top side wherein said first micromechanical spring tongue free end engages said micromechanical second spring tongue free end and wherein said first spring tongue length is less than said second spring tongue length;

forming a tensile stress layer on at least a portion of said top side of each of said first and second micromechanical spring tongues;

forming a plurality of first spring tongue stationary micromechanical contacts on said first spring tongue free end and a plurality of second spring tongue moving micromechanical contacts on said second spring tongue free end;

overlapping each of said first spring tongue stationary micromechanical contacts with said second spring tongue moving micromechanical contacts with said sacrificial layer disposed between each of said second spring tongue moving micromechanical contacts and each of said first spring tongue stationary micromechanical contacts; and upwardly curving said first and second micromechanical spring tongues away from said base substrate by etching so that said first spring tongue free end does not engage said second spring tongue free end.

15. The method of producing a microcmechanical electrostatic relay according to claim 14 comprising depositing a first sacrificial layer, a second sacrificial layer and said electrically conductive carrier layer onto said base substrate of silicon wherein said first sacrificial layer is disposed between said electrically conductive carrier layer and said base substrate, wherein said second sacrificial layer is disposed between said first and second spring tongue free ends and wherein said electrically conductive carrier layer is formed of polysilicon and re-crystallized polysilicon, etching out said first and second sacrificial layers once said first spring tongue free end and said second spring tongue free end each have been fitted with each of said respective first spring tongue stationary micromechanical contacts and second spring tongue moving micromechanical contacts.

16. The method of producing a micromechanical electrostatic relay according to claim 15 comprising electrochemically depositing said first and second micromechanical spring tongues and said first and second sacrificial layers onto said base substrate wherein said first sacrificial layer is deposited between said first and second micromechanical spring tongues and said base substrate, wherein said second sacrificial layer is disposed between said first and second spring tongue free ends, wherein said first and second micromechanical spring tongues are selected from the group consisting of nickel, nickel-iron, and nickel alloys and wherein said base substrate is selected from the group consisting of glass, ceramic, and silicon. fitting each of said first and second spring tongue free ends with each of said respective first spring tongue stationary micromechanical contacts and second spring tongue moving micromechanical contacts wherein each of said second spring tongue moving micromechanical contacts overlaps each of said first spring tongue stationary micromechanical contacts, etching out said first and said second sacrificial layers once each of said first and second spring tongue free ends have been fitted with each of said respective first spring tongue stationary micromechanical contacts and second spring tongue moving micromechanical contacts.

17. The method of producing a micromechanical electrostatic relay according to claim 14 comprising depositing said base electrode and said insulating layer onto said base substrate selected from the group consisting of silicon and glass, bonding an epitaxial layer that includes a silicon wafer with a doped silicon layer onto said base substrate wherein said base electrode and said insulating layer are disposed between said epitaxial layer and said base substrate, etching back said silicon wafer until said doped silicon layer only remains, forming said first and second micromechanical spring tongues by etching said doped silicon layer, fitting each said first and second micromechanical spring tongues with a plurality of respective first spring tongue stationary micromechanical contacts and second spring tongue moving micromechanical contacts so that each of said second spring tongue moving micromechanical contacts overlaps each of said first spring tongue stationary micromechanical contacts and wherein said sacrificial layer is disposed between each of said first spring tongue stationary micromechanical contacts and each of said second spring tongue moving micromechanical contacts, etching away said sacrificial layer.

* * * * *